US005078387A

United States Patent [19]

Faust et al.

[11] Patent Number: 5,078,387

[45] Date of Patent: Jan. 7, 1992

[54] HAND EXERCISE DEVICE

[76] Inventors: Pearl A. Faust; Edward U. Faust, both of H-8 Starkey Pl., Steeple Chase Village, Cardiff, N.J. 08232

[21] Appl. No.: 624,994

[22] Filed: Dec. 10, 1990

[51] Int. Cl.[5] ..... A63B 5/00

[52] U.S. Cl. ..... 272/67; 128/57

[58] Field of Search ..... 272/67, 69; 128/57, 128/25 R, 26, 25 B; 434/258

[56] References Cited

U.S. PATENT DOCUMENTS

| | | | |
|---|---|---|---|
| D. 101,862 | 11/1936 | Fehn et al. | 128/57 |
| 602,191 | 4/1898 | Lucchesi . | |
| 1,581,235 | 4/1926 | Sorel . | |
| 1,608,598 | 11/1926 | Heilborn | 128/57 |
| 1,879,401 | 9/1932 | Monaco . | |
| 2,512,904 | 6/1950 | Strelecky | 128/57 |
| 2,593,982 | 4/1952 | Cash | 128/57 |
| 2,819,714 | 1/1958 | London | 128/57 |
| 2,823,918 | 2/1958 | Lewis . | |
| 3,088,458 | 5/1963 | Stewart . | |
| 3,577,985 | 5/1971 | Guffin | 128/57 |
| 3,779,548 | 12/1973 | Sato . | |
| 3,972,322 | 8/1976 | Finn | 128/57 |
| 4,192,296 | 3/1980 | St. Mary | 128/57 X |
| 4,964,630 | 10/1990 | Curtiss | 272/67 X |

*Primary Examiner*—Richard J. Apley
*Assistant Examiner*—Linda C. M. Dvorak
*Attorney, Agent, or Firm*—Thomas A. Lennox

[57] ABSTRACT

A hand exerciser treatment device includes a frame with peripheral walls bounding a rectangular panel. Three cylindrical rollers with diameters higher than the peripheral walls span the width of the frame and roll the length of the frame. The end walls are at least one-half of the diameter of the cylindrical rollers and a space block interfits into the frame abutting one end to reduce the rolling distance of the rollers which are rolled back and forth with the palm of the hand and the bottom of the fingers to aid in circulation and flexibility.

14 Claims, 2 Drawing Sheets

HAND EXERCISE DEVICE

BACKGROUND OF THE INVENTION

This invention involves an exercising device that is particularly directed to mild exercise of the hands to promote flexibility and maintain movement of the joints for persons suffering from arthritis and like ailments.

It has long been recognized that continuing use of the hands even utilizing very mild and non-strenuous exercise will improve and maintain the maximum possible flexibility and movement of the hands for persons suffering from arthritis or other less serious forms of ailments generally associated with advanced age. It is also well recognized that exercise is very beneficial for a person who has suffered an injury such as to the hand or wrist.

Various types of devices including sponge rubber balls and pairs of relatively heavy steel balls have been used with various exercises to improve flexibility and hasten recovery of an ailment or an injury. However, older persons do not have the strength or dexterity to handle and move spherical objects within a hand. There is a need for a less strenuous device which improves or at least tends to maintain the flexibility of the persons hands.

None of the devices provided in the prior art provide the simplicity and effectiveness necessary to attain this purpose or satisfy the objects described hereinbelow.

SUMMARY OF THE INVENTION

In an attempt to construct a hand exercise device which allows the person to roll the hands back and forth along the top of a plurality of rollers, various designs were considered. While it is desirable to provide a single exercise device in the market place suitable for all persons, it was determined that the varying sizes of hands necessitated an adjustability feature be incorporated into the device. It was found that if the rollers were large enough to allow easy exercise by a person with large hands, the rollers were too large for a person with smaller hands. If the rollers were made larger, it was possible for the person with smaller hands to get the tips of the fingers stuck between the rollers and pinch them. Likewise, a person with large hands found a smaller device to be inadequate to allow full movement of the hands during the exercise. In addition, persons with severe handicaps limiting movement of the hands and with very limited flexibility find that only a small rolling movement is sufficient in earlier stages of recovery from an accident or for the limited capabilities of the aged. As a consequence, the size of the rollers as well as the horizontal movement of the rollers varies considerably from person to person and condition to condition. None of the devices found in the prior art satisfied this need for versatility.

It is therefore a specific object of the present invention to provide a hand exercising treating device that utilizes a rolling movement upper surface allowing the hand to press downwardly on the rollers and roll the surface back and forth to improve circulation and flexibility of the person's hand.

It is a specific object of the present invention to provide a device for hand exercise treatment that is adjustable as to the size of the hand of the person using the device and the relative horizontal movement of the person's hand during the exercise.

It is an additional object of the present invention to provide a device that kneads the palm and fingers of a person's hand promoting circulation and flexibility.

It is a further object of the present invention to provide a device that employs free rollers for maximum versatility that does not tend to catch the ends of the fingers during the exercise.

It is an additional object of the present invention to provide a hand exercise device with no mechanical attachments which might require maintenance or even lubrication.

It is a further object of the present invention to provide an apparatus to allow the hand to roll on top of rollers with the length of the rolling being adjustable.

It is an additional object of the present invention to provide a hand treating device wherein the person can control the speed and pressure of the rolling exercise.

It is a final object of the invention to provide a hand exercise device that is portable.

An aspect of the invention is a hand exerciser device that includes a frame platform including a rectangular platform base panel, and a frame wall attached around the periphery of the platform base panel. The platform base panel includes first and second end wall members each having inside end surfaces with heights above the platform base panel, the horizontal distance between these inside end surfaces being an inside frame length. The platform base panel further includes side wall members each having inside side surfaces with heights above the platform base panel, the horizontal distance between these inside side surfaces being an inside frame width. The device also includes at least two cylindrical roller members to interfit into the frame platform, each roller member having ends and includes lengths and diameters sufficient to transversely span the inside frame width and freely roll the inside frame length with the ends of the roller members guided by the inside side surfaces to prevent turning of the cylindrical members lengthwise to the length of the sidewalls. The diameters of the cylindrical roller members are equal to each other cylindrical roller member, greater than the heights of the inside side surfaces side the inside end surfaces, less than twice the heights of the inside end surfaces, less than twice the heights of the inside end surfaces, and sufficient that the length of the combined diameters of the cylindrical roller members is at least one-quarter the length of the inside frame length. It is preferred that the device further include a spacer block member to interfit into the frame platform abutting one end surface, the spacer block member having a length to span the inside frame width and a width proximate one-quarter the inside frame length, wherein, with the spacer block member inserted in the frame platform the usable inside frame length is reduced to a reduced inside frame length.

It is preferred that the heights of the inside end surfaces and the inside side surfaces be equal. It is further preferred that the heights of the inside end surfaces and the inside side surfaces be about three-quarters of an inch to about one inch high. It is more preferred that the heights of the inside end surfaces and the inside side surfaces be about seven-eighths inch high. It is also preferred that the inside frame length be about eight inches. It is further preferred that there be at least three cylindrical roller members and more preferred that there be three cylindrical roller members. It is also preferred that each cylindrical roller member be about one to about one and one-half inches in diameter and more preferred that each cylindrical roller member be about one and one-quarter inches in diameter. It is further preferred that the length of the combined diameters to the cylindrical roller members be about one-quarter to about two-thirds of the inside frame length and more preferably about one third to about one-half of the inside frame length. It is also preferred that the length of the combined diameters to the cylindrical roller members be about two to about five inches. It is further preferred that the length of the combined diameters of the cylindrical roller members be about seven sixteenths to about two-thirds of the reduced inside frame length. A preferred combination for the hand exerciser device is three cylindrical roller members with diameters that are sufficient that the length of the combined diameters of the cylindrical roller members be about one-quarter to about two-thirds of the inside frame length and about seven-sixteenths to about two-thirds of a reduced inside frame length.

DESCRIPTION OF PREFERRED EMBODIMENTS

Figure 1:
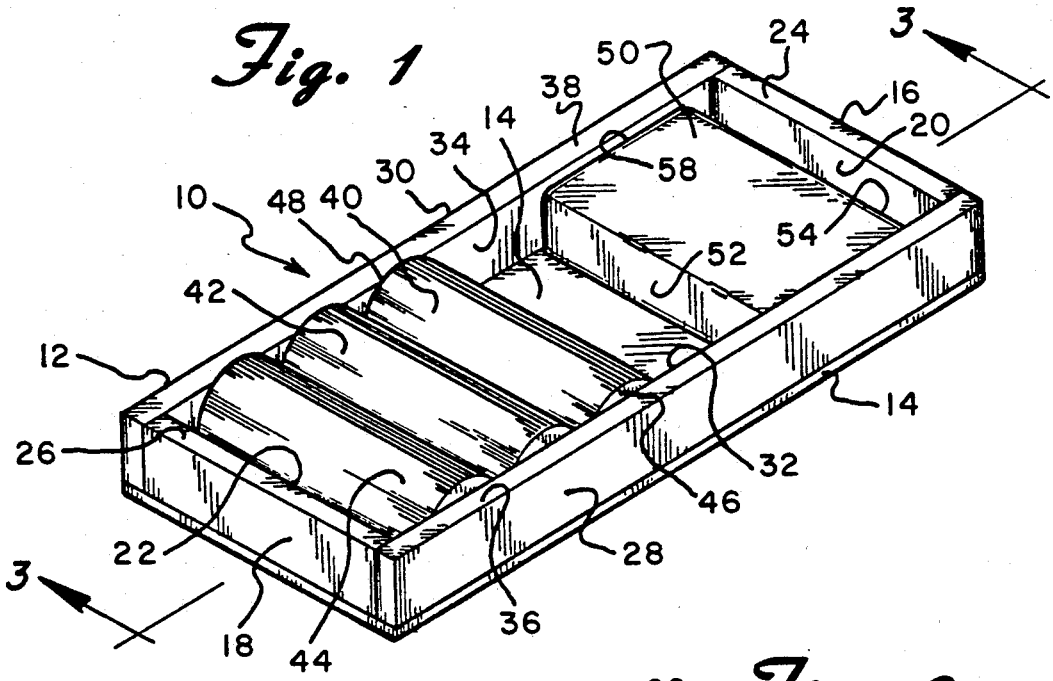
FIG. 1 is a perspective view of a hand exercise device of the present invention.

Hand exerciser device 10 is illustrated in FIG. 1 constructed entirely out of wood, each part being formed separately and the frame constructed using standard wood glue and mechanical fasteners. Alternate materials may be used, such as extruded polymeric plastic for the rollers and cast or extruded polymeric plastic panels for the flat parts. Solvent or other adhesives may be used to attach the plastic parts together.

Figure 2:
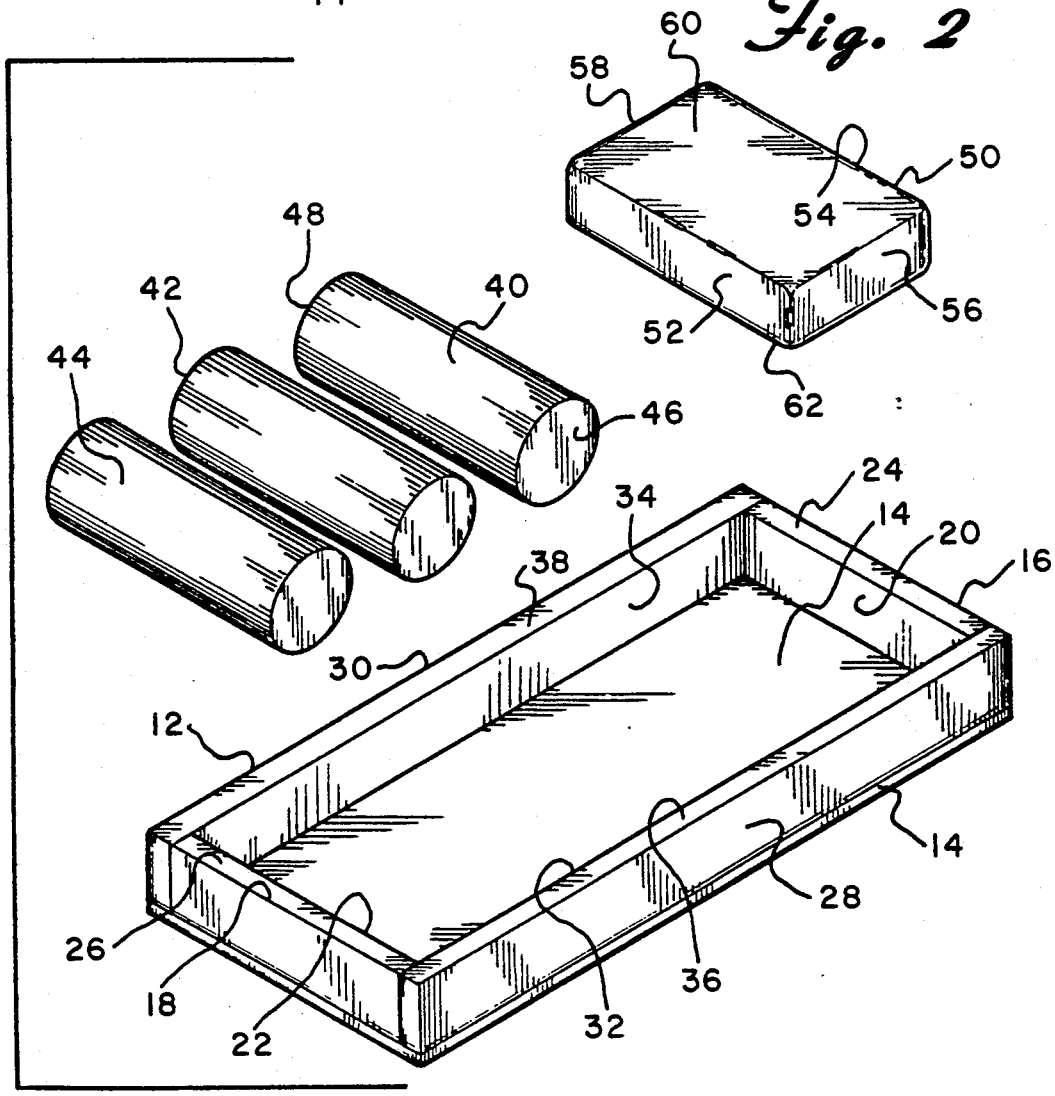
FIG. 2 is an exploded perspective view showing the parts of the device illustrated in FIG. 1.
Figure 3:
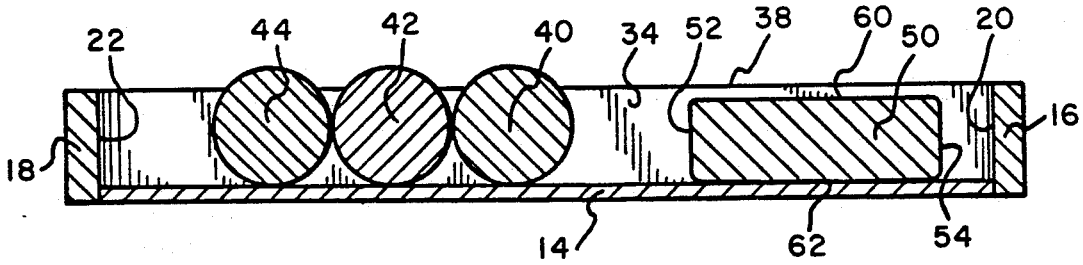
FIG. 3 is a cross sectional view taken along line 3—3 of FIG. 1.
Figure 4:
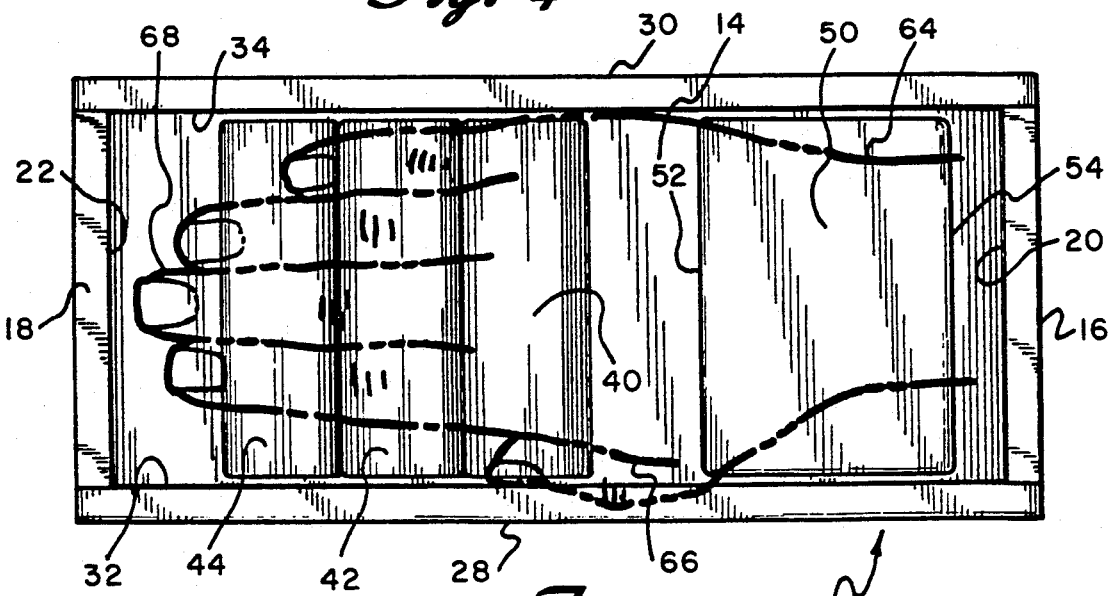
FIG. 4 is a top plan view of the device illustrated in FIG. 1 with a diagram positioning a small size hand illustrating use of the device.
Figure 5:
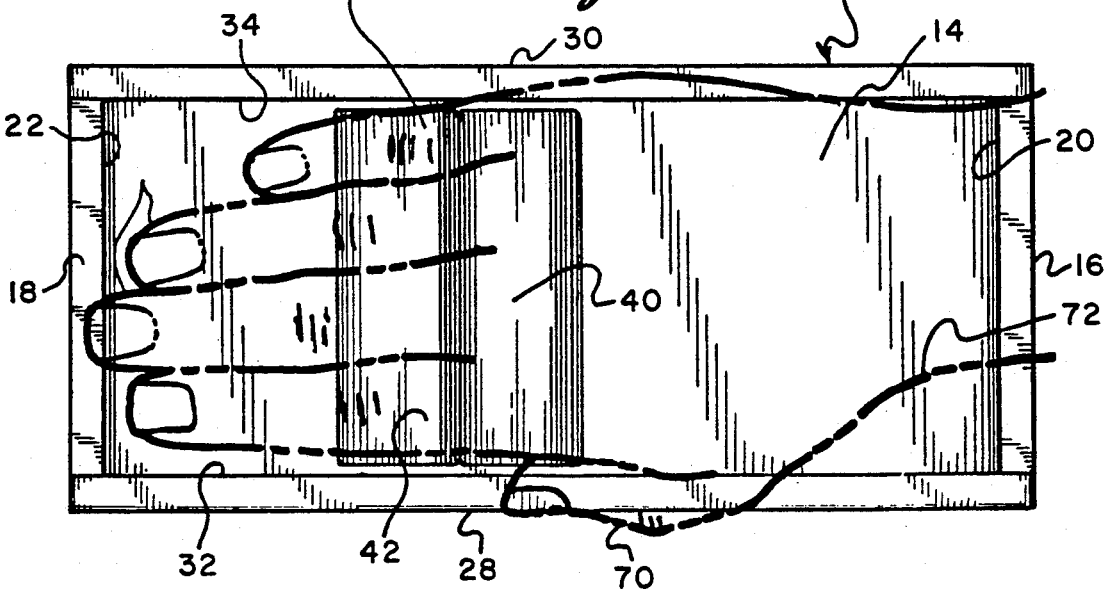
FIG. 5 is a top plan view of the device illustrated in FIG. 1 with one roller and the block removed with a diagram of a larger size hand using the device.

Device 10 includes frame platform 12 which is constructed on panel 14 which is about four inches wide and about eight and three-quarter inches long. A periphery frame wall is attached to panel 14 including end wall members 16 and 18 and side wall members 28 and 30. All of the side walls extend about seven-eighths inch above base panel 14 to the top edges of the wall members. End wall members 16 and 18 terminate at top edges 24 and 26, respectively, while side wall members 28 and 30 terminate at top edges 36 and 38, respectively. All of the wall members are about one-quarter inch thick. Each of the end wall members have an inner surface, surface 20 on end wall 16 and surface 22 on wall 18. These wall surfaces are essentially vertical and extending upwardly from base panel 14 about seven-eighths of an inch. The distance between surfaces 20 and 22 is the inside frame length and is the maximum length that rollers rolling on base panel 14 can roll before reaching the opposite end wall. Each of side walls 28 and 30 have vertical inside surfaces, 32 and 34 respectively. The distance between surfaces 32 and 34 is the inside frame width, these surfaces being used to guide the rollers as they roll the length of the frame platform. Rollers 40, 42, and 44 are identical solid cylindrical roller members about one and one-quarter inches in diameter and about three and one-quarter inches long. The inside frame width is about three and one-half inches allowing the rollers to roll freely up and down the length of frame platform 12 without binding. The side wall surfaces provide sufficient guidance that the rollers cannot become canted to an angle and wedge in the frame. Roller 40 and all identical rollers, has circular ends 46 and 48 each being about one and one-quarter inches in diameter. The combined diameters of two of the rollers is about two and one-half inches and that combined sum is slightly more than one-quarter of the inside frame length. The combined diameters of three of the rollers is about three and three-quarter inches and almost one-half of the distance of the inside frame length. Spacer block 50 is spaced to interfit into frame platform 12 and abut one end surface, a length surface being placed in this embodiment abutting surface 20 of end wall 16. Spacer block member 50 has identical rectangular top and bottom surfaces 60 and 62 which is about two and one-quarter inches wide and about three and one-quarter inches long, the length being positioned to span the inside frame width. End surfaces 56 and 58 abut inside surfaces 32 and 34, respectively. Side surface 54 abuts inside end wall inter-surface 20 with side surface 52 facing end wall 18. With block 50 in this position the rollers are rolled up and down the effective inside frame length from surface 22 to surface 52. Although not illustrated block 50 may be turned ninety degrees so that the length of the block is aligned with the inside frame length. In this configuration with block turned clockwise end surface 58 provides the stopping surface for the rollers. With three rollers in the frame roller movement is reduced to about one inch as compared to about two inches with block positioned as shown in FIGS. 1 and 4. These surfaces and lengths are more clearly shown in FIGS. 2 and 3. In FIG. 4, device 10 is shown in use using all three rollers plus spacer block 50. Rollers 40, 42 and 44 are free to roll between the stops of end surface 22 and spacer block surface 52. Although block 50 is shown a small distance away from end wall 16, in use, surface 54 would be abutted directly against 20 leaving about two inches of movement space for the rollers. For small hands, such as hand 66, diagramed in FIG. 4, this limited movement of about one-quarter of the length of the inside frame, is sufficient, particularly for those having severe infirmatives. For larger hands and for persons requiring more vigorous movement, device 10 is changed in FIG. 5 to remove spacer block 40 as well as roller 44 leaving rollers 40 and 42 to roll the entire inside frame length from surface 20 to surface 22. In this configuration, the larger hand and the greater control of the person using the device avoids pinching the ends of fingers 74 of hand 70 while the palm or wrist 72 of the hand is proximate end wall 16. In the configuration shown in FIG. 4, it is almost impossible to catch the smaller fingers 68 between roller 44 and end 22 or palm 64 of hand 66 due to the limited movement of the rollers and the limited amount of space for movement of the rollers from end position to end position. Thus, the greater the dexterity and the larger the hand allows the removal of spacer block 50 and even one or more of the rollers. Devices are generally provided with all of the rollers and the spacer block to present the greatest versatility for the device.

While this invention has been described with reference to the specific embodiments disclosed herein, it is not confined to the details set forth and the patent is intended to include modifications and changes which may come within and extend from the following claims.

We claim:

1. A hand exerciser device comprising:

(A) a frame platform comprising:

(i) a rectangular platform base panel, and (ii) a frame wall attached around the periphery of the platform base panel comprising:

(a) first and second end wall members each having inside end surfaces with heights above the platform base panel, the horizontal distance between these inside end surfaces being an inside frame length, and (b) side wall members each having inside side surfaces with heights above the platform base panel, the horizontal distance between these inside side surfaces being an inside frame width, (B) at least two cylindrical roller members to interfit into the frame platform, each roller member having ends and comprising:

(i) lengths and diameters to transversely span the inside frame width and freely roll the inside frame length with the ends of the roller members guided by the inside side surfaces to prevent turning of the cylindrical members lengthwise to the length of the sidewalls, and (ii) diameters that are:

(a) equal to each other cylindrical roller member, (b) greater than the heights of the inside side surfaces and the inside end surfaces, (c) less than twice the heights of the inside end surfaces, and (d) sufficient that the length of the combined diameters of the cylindrical roller members is at least one-quarter the length of the inside frame length, and (C) a spacer block member to interfit into the frame platform abutting one end surface, the spacer block member having a length to span the inside frame width and a width proximate one-quarter the inside frame length, wherein, with the spacer block member inserted in the frame platform the usable inside frame length is reduced to a reduced inside frame length.

2. The device of claim 1 wherein the heights of the inside end surfaces and the inside side surfaces are equal.

3. The device of claim 2 wherein the heights of the inside end surfaces and the inside side surfaces are about three quarters of an inch to about one inch high.

4. The device of claim 3 wherein the heights of the inside end surfaces and the inside side surfaces are about seven eights inch high.

5. The device of claim 1 wherein the inside frame length is about eight inches.

6. The device of claim 1 wherein there are at least three cylindrical roller members.

7. The device of claim 1 wherein there are three cylindrical roller members.

8. The device of claim 1 wherein each cylindrical roller member is about one to about one and one-half inches in diameter.

9. The device of claim 8 wherein each cylindrical roller member is about one and one-quarter inches in diameter.

10. The device of claim 1 wherein the length of the combined diameters of the cylindrical roller members is about one-quarter to about two-thirds of the inside frame length.

11. The device of claim 8 wherein the length of the combined diameters of the cylindrical roller members is about one third to about one-half of the inside frame length.

12. The device of claim 5 wherein the length of the combined diameters of the cylindrical roller members is about two to about five inches.

13. The device of claim 1 wherein the length of the combined diameters of the cylindrical roller members is about seven sixteenths to about two-thirds of the reduced inside frame length.

14. A hand exerciser device comprising:

(A) a frame platform comprising:

(i) a rectangular platform base panel, and (ii) a frame wall attached around the periphery of the platform base panel comprising:

(a) first and second end wall members each having inside end surfaces with heights above the platform base panel, the horizontal distance between these inside end surfaces being an inside frame length, and (b) side wall members each having inside side surfaces with heights above the platform base panel, the horizontal distance between these inside side surfaces being an inside frame width, (B) three cylindrical roller members to interfit into the frame platform, each roller member having ends and comprising:

(i) lengths and diameters to transversely span the inside frame width and freely roll the inside frame length with the ends of the roller members guided by the inside side surfaces to prevent turning of the cylindrical members lengthwise to the length of the sidewalls, and (ii) diameters that are:

(a) equal to each other cylindrical roller member, (b) greater than the heights of the inside side surfaces and the inside end surfaces, (c) less than twice the heights of the inside end surfaces, and (d) sufficient that the length of the combined diameters to the cylindrical roller members is about one-quarter of about two-thirds of the inside frame length about seven sixteenths to about two-thirds of a reduced inside frame length, and (C) a spacer block member to interfit into the frame platform abutting one end surface, the spacer block member having a length to span the inside frame width and a width wherein, with the spacer block member inserted in the frame platform, the usable inside frame length is reduced to the reduced inside frame length.

* * * * *